US006510590B1

(12) United States Patent
Lin

(10) Patent No.: US 6,510,590 B1
(45) Date of Patent: Jan. 28, 2003

(54) SLIP PROOF DEVICE FOR A NECKTIE HAVING A ZIPPER THEREON

(76) Inventor: Hsin-Heng Lin, No. 122, Chung-Cheng Rd., Hou-Lung Chen, Miaoli Hsien (TW)

( * ) Notice: Subject to any disclaimer, the term of this patent is extended or adjusted under 35 U.S.C. 154(b) by 0 days.

(21) Appl. No.: 09/947,734

(22) Filed: Sep. 6, 2001

(51) Int. Cl.[7] ..... A41D 25/04

(52) U.S. Cl. ..... 24/66.9; 24/49.1; 24/59; 24/66.8; 2/150; 2/153

(58) Field of Search ..... 24/66.9, 66.8, 24/49.1, 59, 115 H; 2/150, 152, 153

(56) References Cited

U.S. PATENT DOCUMENTS 3,898,698 A * 8/1975 Byrd et al. ..... 2/150
4,615,048 A * 10/1986 Gasser ..... 2/153
4,656,672 A * 4/1987 Lande ..... 2/150
4,835,794 A * 6/1989 Chen et al. ..... 24/66.9
5,170,507 A * 12/1992 Langford et al. ..... 2/150

* cited by examiner

*Primary Examiner*—Victor Sakran
(74) *Attorney, Agent, or Firm*—Jackson Walker L.L.P.

(57) ABSTRACT

A slip proof device for a necktie having a zipper thereon has a slide mounted on a bracket supporting a knot of the necktie. A controlling member is mounted onto the slide and extends a restricting hook having a sharp point through the slide. Thereby, the sharp point is able to extend into a gap defined between teeth of the zipper to secure the slide to the zipper and prevents the knot from slipping loose. Furthermore, the sharp point is able to withdraw from the gap to allow free adjustment of the slide with respect to the zipper.

3 Claims, 7 Drawing Sheets

SLIP PROOF DEVICE FOR A NECKTIE HAVING A ZIPPER THEREON

BACKGROUND OF THE INVENTION

1. Field of the Invention

The present invention relates to a slip proof device for a necktie having a zipper thereon, and more particularly to a slip proof device for a necktie that can provide a convenient operation of the necktie and prevent undesirable slipping of the necktie.

2. Description of Related Art

Neckties are a popular kind of personal adornment, and are especially important in a formal dressing of a man. A nice suit together with an appropriate necktie can bring a good sense of elegance to a person's appearance. In order to achieve this result, not only must the necktie have an attractive color and pattern, but also a knot of the necktie must be tied neatly. However, to tie the knot neatly requires a certain degree of skill and a person may have difficulty in getting a good looking knot. In today's modern society, this traditional kind of necktie is inefficient and can be improved.

With reference to FIG. 6, a necktie with a zipper thereon is shown. The necktie has a knot (70). A supporting bracket (72) is mounted inside the knot (70) to readily give the tie neatness. The necktie has a looped portion (76) to reeve around a wearer's neck, and the looped portion (76) has a zipper (78) mounted thereon. Two ends of the looped portion (76) are joined together by teeth of the zipper (78) meshing with one another by a slide (74) mounted on the bracket (72) and inside the knot (70). Accordingly the size of the looped portion (76) can be easily adjusted by sliding the knot (70) upwardly or downwardly. Therefore the necktie is able to be conveniently put on or taken off without deforming the knot (70).

Although the necktie having the zipper thereon mentioned does have the advantage of convenience during putting on or taking off, the knot (70) is positioned by the zipper (78) cooperating with the slide (74), whereby the positioning is not secure and may gradually slip during wear. In order to mitigate the slipping problem of the necktie, the slide (74) of the necktie has been improved. With reference to FIG. 7, an improved necktie with a zipper thereon is shown, and a slip proof device (80) is added to replace the slide (74) previously mentioned. The slip proof device (80) has a similar structure of a common zipper slide, and includes a base (82) and a tab (84) pivotally connected with base (82). The main characteristic of the slip proof device (80) is that a sharp point (842) is provided in an end of the tab (84), and the sharp point (842) is able to extend into a gap between teeth of a zipper (88). When the sharp point (842) is extended into the gap, the slip proof device (80) is secured to the zipper (88), and when the sharp point (842) is not in the gap, the slip proof device (80) can be adjusted freely, thereby mitigating the slipping problem previously mentioned.

However, the necktie having the slip proof device (80) still has the following problem. To secure or release the slip proof device (80), a user has to pivot the tab (84) which controls the sharp point (842). To pivot the tab (84) may be inconvenient because the tab (84) is small. In particular, a wearer of the tie cannot directly see the tab (84) without the aid of a mirror, and has to feel by hand for the tab (84) to find it. This operating procedure of the slip proof device (80) is inconvenient and needs be further improved.

Therefore, the present invention tends to provide an improved slip proof device for a necktie having a zipper thereon to mitigate or obviate the aforementioned problems.

SUMMARY OF THE INVENTION

An objective of the present invention is to provide a slip proof device for a necktie having a zipper thereon such that the slip proof device can enable convenient putting on and taking off of the necktie.

Another objective of the present invention is to provide a slip proof device for a necktie having a zipper thereon such that the slip proof device is able to prevent a knot of the necktie from slipping loose.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
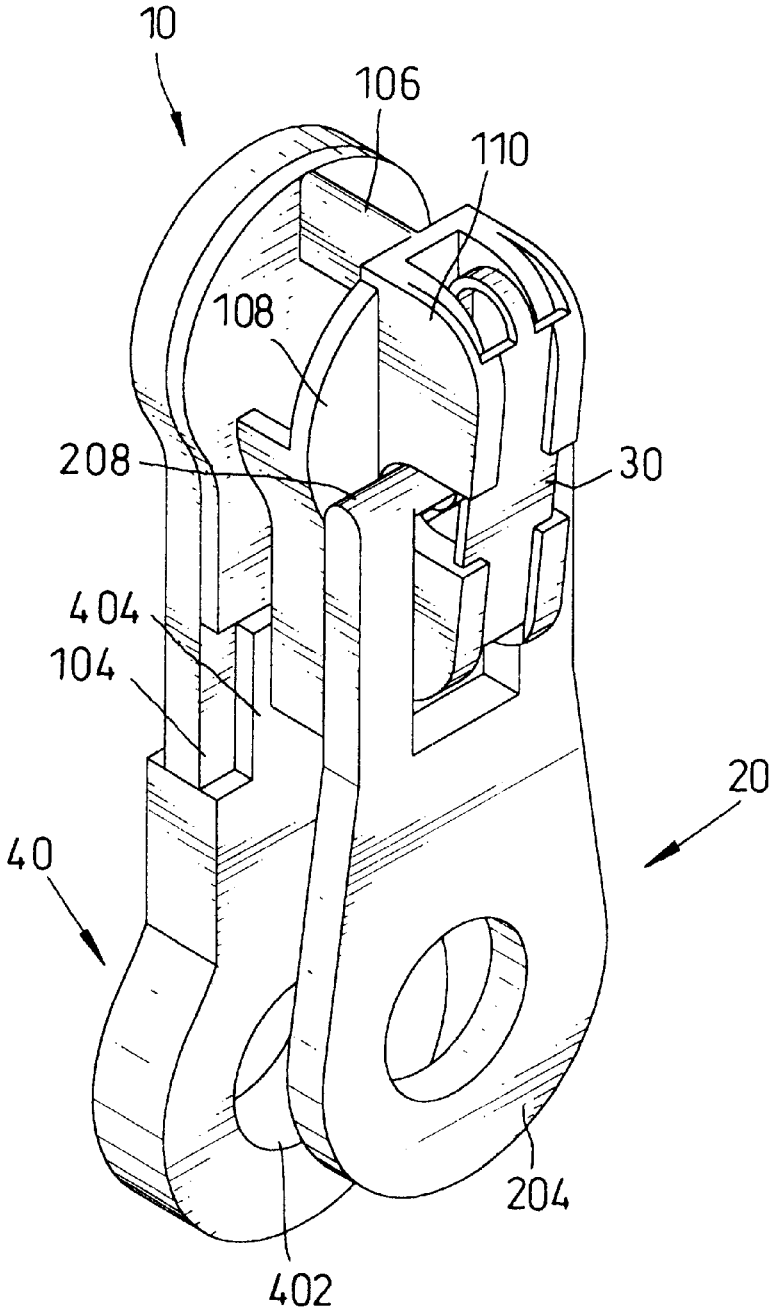
FIG. 1 is a perspective view of a slip proof device for a necktie having a zipper thereon in accordance with the present invention in assembly.
Figure 2:
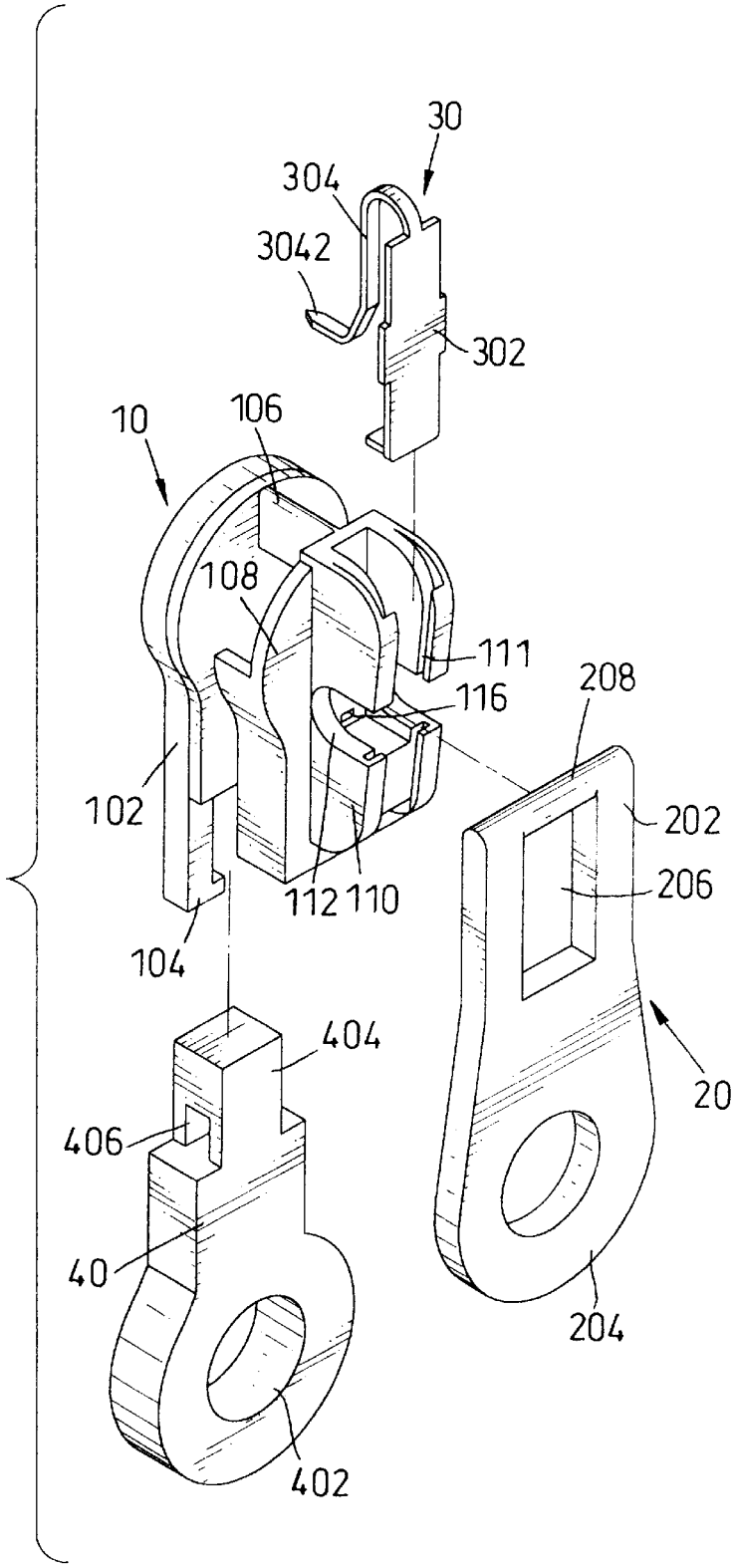
FIG. 2 is an exploded, perspective view of the slip proof device.

With reference to FIGS. 1 and 2, a slip proof device for a necktie having a zipper thereon has a slide (10), a tab (20), a controlling member (30), and a tail plate (40).

The slide (10) has a base plate (102) and a cover plate (108). The base plate (102) and the cover plate (108) are parallel to each other and connected together by a column integrally formed between respective head ends of the base plate (102) and the cover plate (108). Two tail hooks (104) integrally extend from a rear end of the base plate (102) for connecting with the tail plate (40). The cover plate (108) has two walls (110) longitudinally formed in an outer surface of the cover plate (108) and spaced in a proper distance. Each of the walls (110) has a cutout (112) defined in a center portion of the wall (110) and a receiving slot (111) longitudinally defined near a distal edge of the wall (110), wherein the cutouts (112) align with each other. A through hole (116) is defined in the cover plate (108) and between the two cutouts (112).

The tab (20) has a connecting portion (202) and a pressing portion (204). The connecting portion (204) has an opening (206) defined therein and a connecting rod (208) integrally formed at a distal end of the connecting portion (202) and on top of the opening (206).

The controlling member (30) has a flat plate (302) and a restricting hook (304) integrally extending from a head end of the controlling member (30). The restricting hook (304) has a free end configured as a sharp point (3042) to extend through the through hole (116) defined in the cover plate (108).

The tail plate (40) has a rivet hole (402) defined therethrough and a protrusion (404) integrally formed at an end of the tail plate (40). A through bore (406) transversely extends through the protrusion (404) to receive the connecting hooks (104) of the base plate (102) and thereby connects the tail plate (40) to the base plate (102).

When assembling the slip proof device, the connecting rod (208) extends transversely through the cutouts (112) defined in the walls (110) and the walls (110) extends into the opening (206) defined in the tab (20). Further the two sides of the flat plate (302) of the controlling member (30) respectively slide into the receiving slots (111) defined in the walls (110) while the sharp point (3042) of the restricting hook (304) extends through the through hole (116) defined in the cover plate (108). Therefore, the connecting rod (208) is restricted inside the cutouts (112) by the restricting hook (304) of the controlling member (30) and pivotally connects the tab (20) to the cover plate (108). Further, the connecting hooks (104) of the base plate (102) extend into the through bore (406) defined in the protrusion (404) of the tail plate (40) and thereby pivotally connects the tail plate (40) to the base plate (102).

Figure 3:
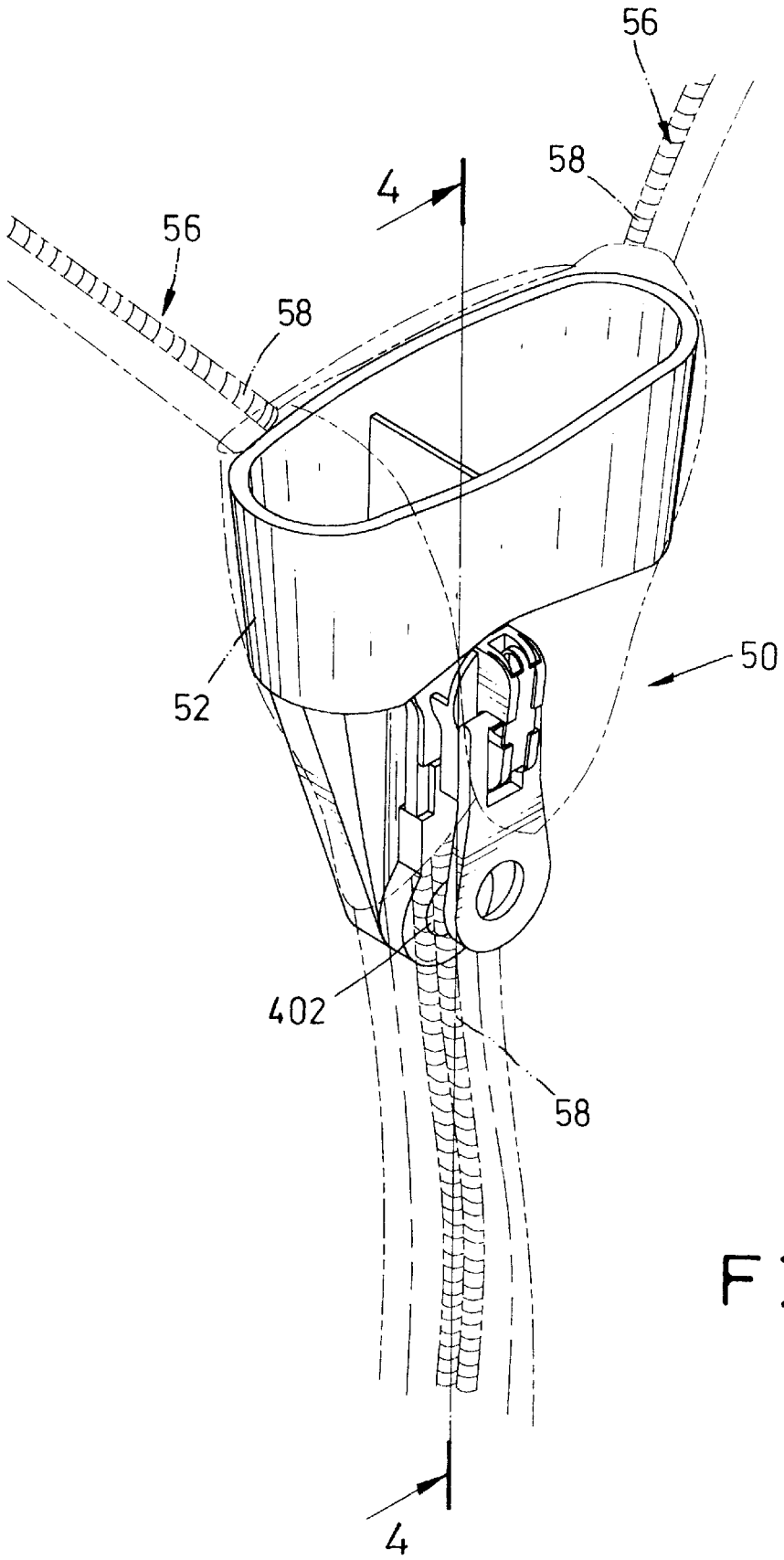
FIG. 3 is a perspective view of the slip proof device assembled onto the necktie having the zipper thereon.

With reference to FIG. 3, the slip proof device is assembled onto a bracket (52) disposed inside a knot (50) of the necktie using a rivet extending through the rivet hole (402) and the bracket (52). The necktie has a looped portion (56) mounted with a zipper (58). Two ends of the looped portion (56) pass through a space defined between the base plate (102) and the cover plate (108) and are joined together by teeth of the zipper (58) meshing with one another.

Figure 4:
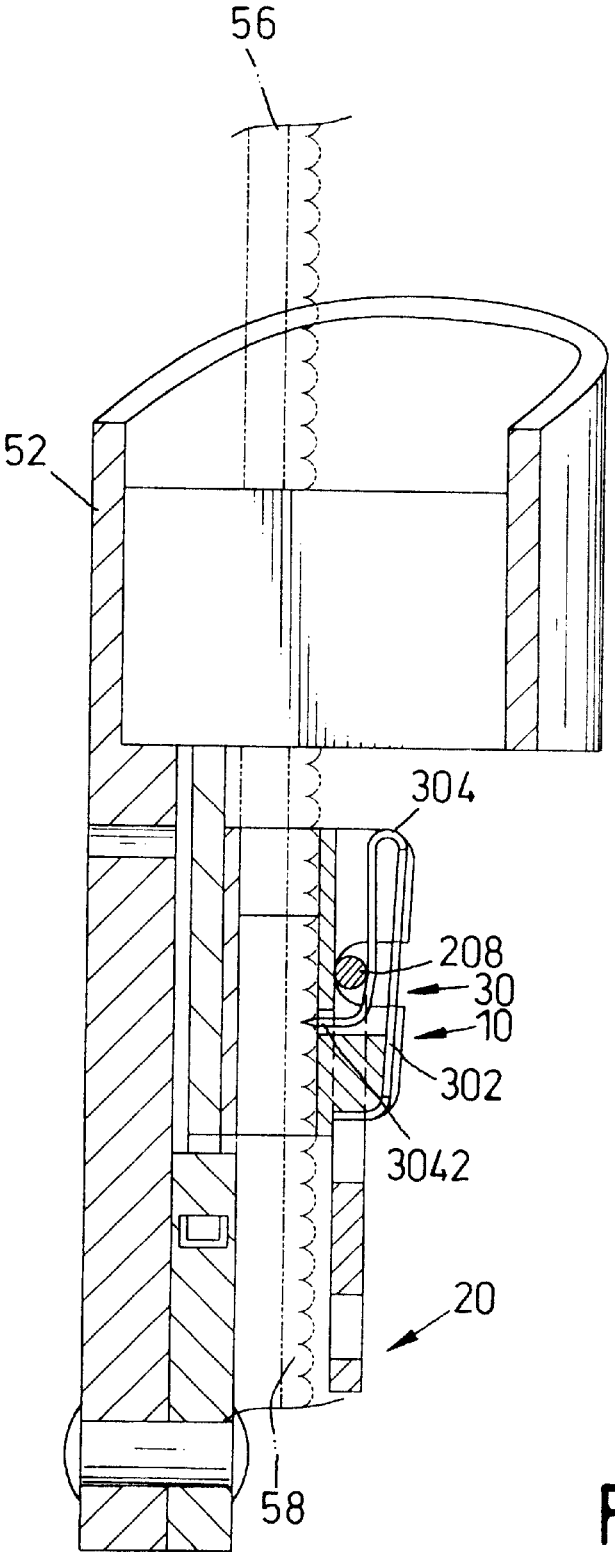
FIG. 4 is a cross-sectional view of the slip proof device in a secured state taken along line 4—4 of FIG. 3.

With reference to FIG. 4, when the slip proof device is in a secured state, the sharp point (3042) of the restricting hook (304) of the controlling member (30) extends through the through hole (116) of the cover plate (108) and further into a gap between the teeth of the zipper (58). With the extending of the sharp point (3042) into the gap, the relative position between the slide (10) and the zipper (58) is secured, and therefore prevents the slipping of the zipper (58).

Figure 5:
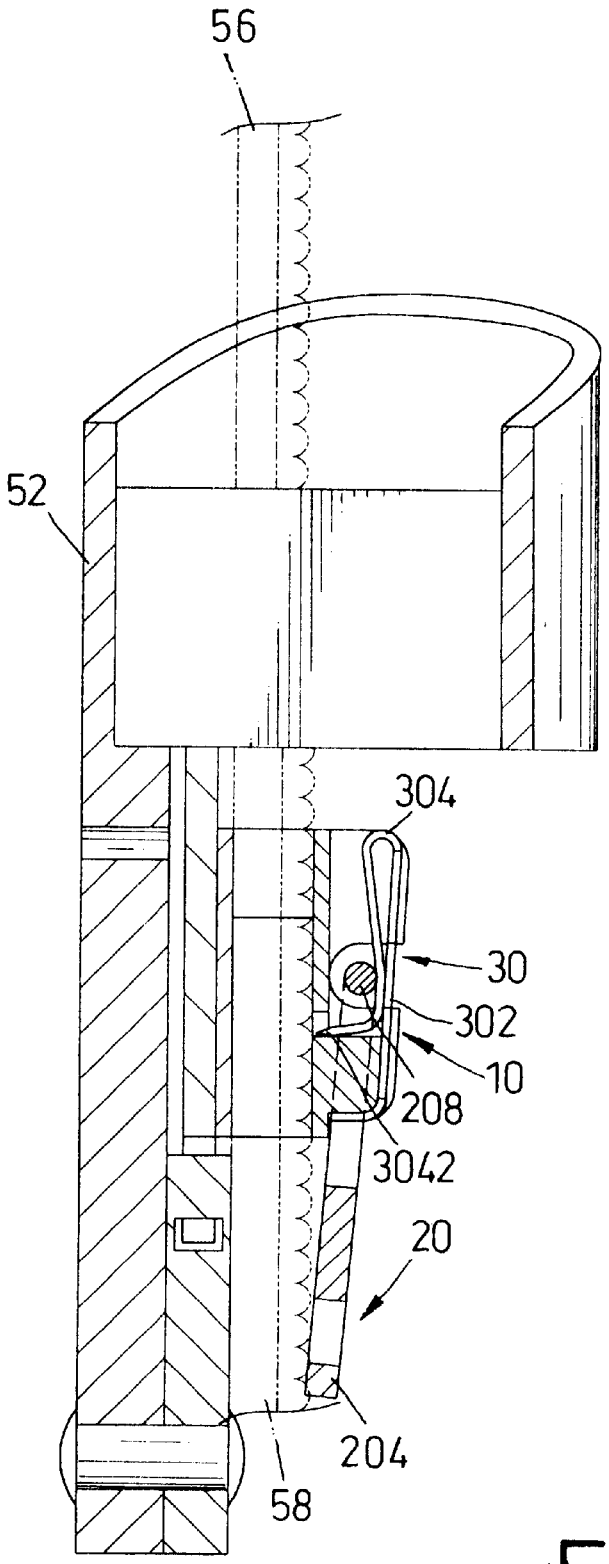
FIG. 5 is a cross-sectional view of the slip proof device in a released state.
Figure 6:
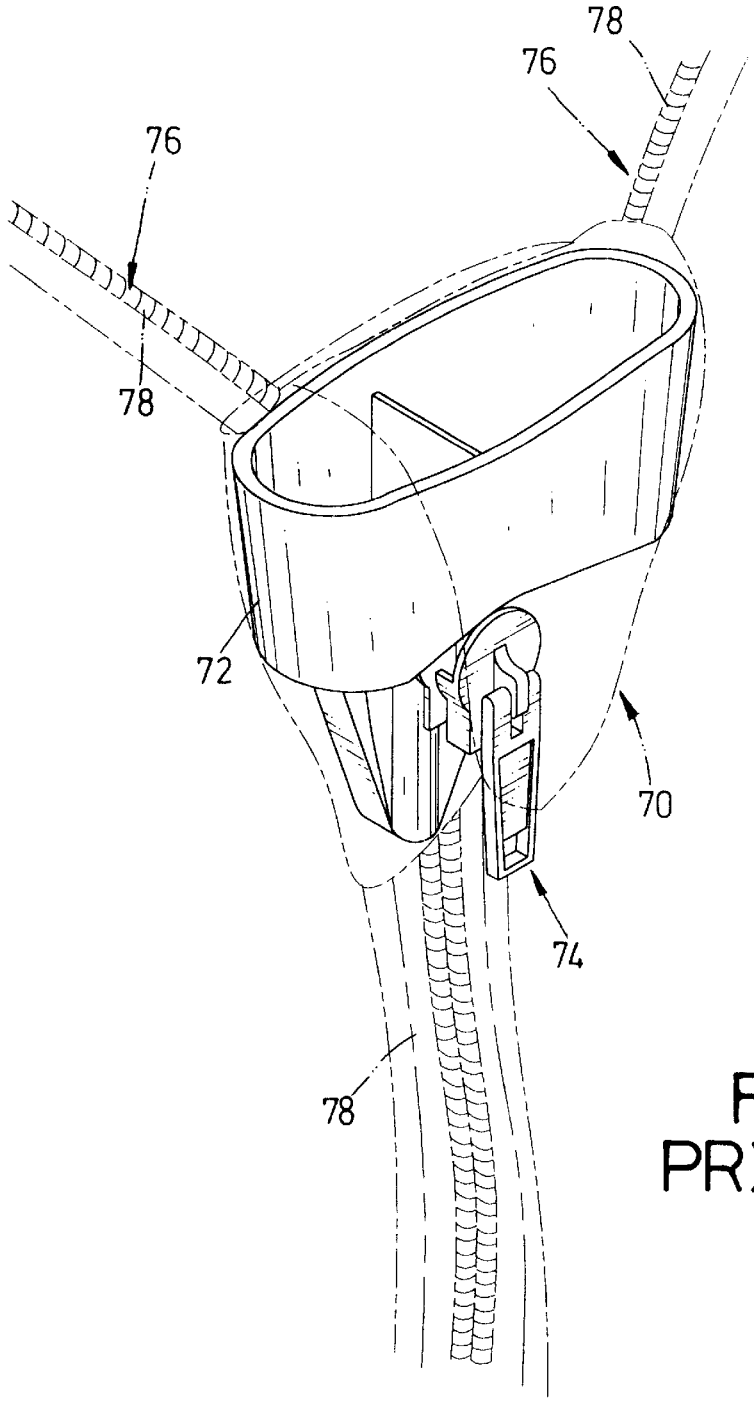
FIG. 6 PRIOR ART
FIG. 6 is a perspective view of a conventional necktie having a zipper thereon.
Figure 7:
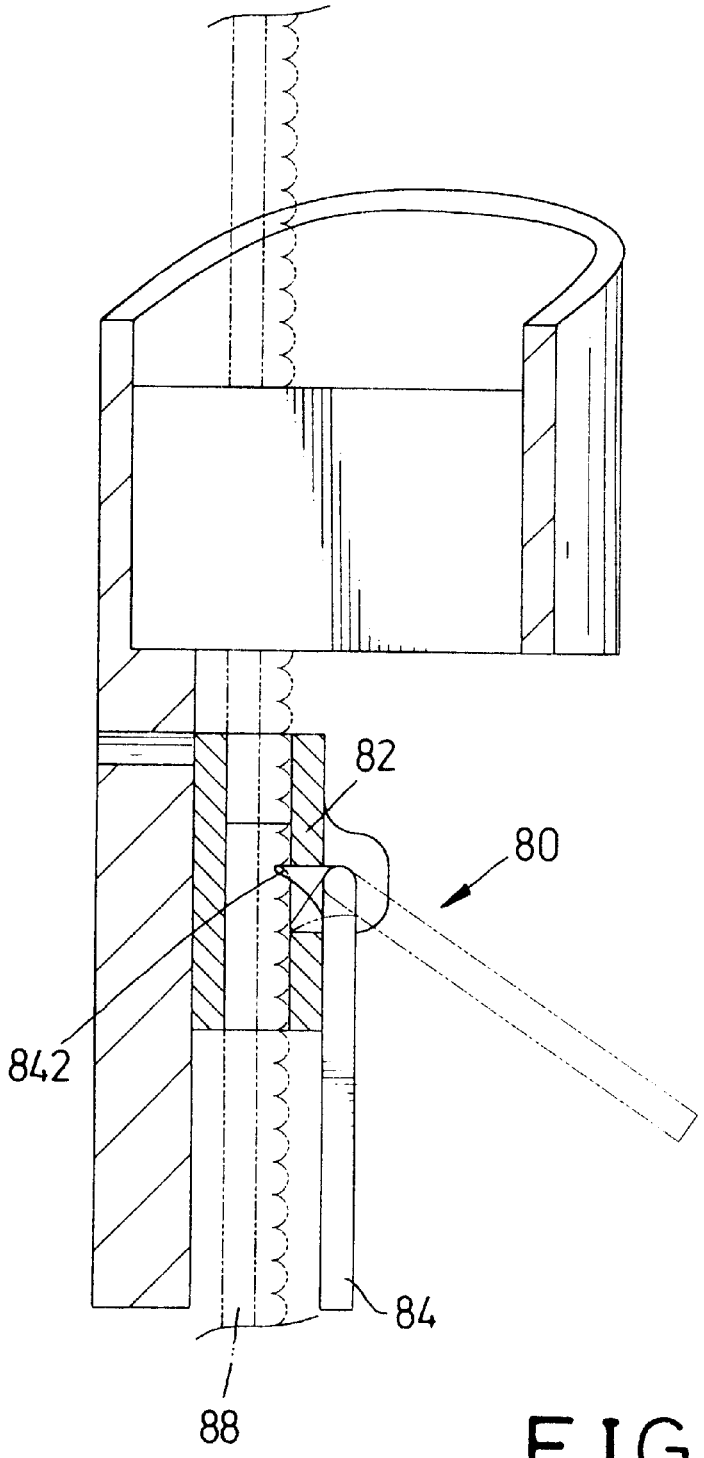
FIG. 7 PRIOR ART
FIG. 7 is an operational, cross-sectional view showing a conventional slip proof device for a necktie having a zipper thereon.

With reference to FIG. 5, when a user desires to adjust the size of the looped portion (56) in order to put on or take off the necktie, the pressing end (204) of the tab (20) is pressed toward the zipper (58). When the pressing end (204) is pressed, the connecting rod (208) moves away from the zipper (58) correspondingly and also pushes the restricting hook (304) in the same direction so as to withdraw the sharp point from the gap of the zipper (58). Consequently, the slide (10) is no longer immovably secured to the zipper (58) and thereby allows free adjustment of the necktie.

From the above description, it is noted that the invention has the following advantages:

1. The knot of the necktie is always ready for the user to instantly put it on.
2. The slip proof device can enable the necktie to be conveniently put on and taken off.
3. The slip proof device can prevent the knot from undesirably slipping loose.

While this invention has been particularly shown and described with references to preferred embodiment thereof, it will be understood by those skilled in the art that various changes in form and details may be made therein without departing from the scope of the invention encompassed by the appended claims.

What is claimed is:

1. A slip proof device for a necktie having a zipper thereon, the necktie having a knot and a bracket disposed inside the knot, the slip proof device comprising:

a slide adapted to be securely mounted on the bracket to mesh teeth of the zipper;

a controlling member mounted on the slide, and having a restricting hook extending therefrom to be able to selectively extend into a gap defined between the teeth of the zipper; and a tab moveably connected to the slide and abutted the restricting hook so as to control the extending of the restricting hook into the gap, whereby, the slide is able to be secured to the zipper by extending the restricting hook into the gap defined between the teeth of the zipper and therefore prevents the knot of the necktie from slipping loose.

2. The slip proof device as claimed in claim 1 further comprising a tail plate pivotally connected to the slide to be riveted onto the bracket.

3. The slip proof device as claimed in claim 2, wherein the two walls each have a cutout defined therein, and the tab has a connecting rod received in the cutouts, the restricting member securely received between the walls restricts the connecting rod in the cutout so as to moveably connect the tab to the slide.

* * * * *